US007554227B2

(12) United States Patent
Horng et al.

(10) Patent No.: US 7,554,227 B2
(45) Date of Patent: Jun. 30, 2009

(54) HEAT-DISSIPATING DEVICE FOR MOTOR BASE

(75) Inventors: Alex Horng, Kaohsiung (TW); Tso-Kuo Yin, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 401 days.

(21) Appl. No.: 11/484,569

(22) Filed: Jul. 12, 2006

(65) Prior Publication Data

US 2007/0243083 A1 Oct. 18, 2007

(30) Foreign Application Priority Data

Apr. 13, 2006 (TW) ..... 95113089 A

(51) Int. Cl.
*F04B 35/04* (2006.01)

(52) U.S. Cl. ..... 310/64; 310/52; 310/67 R; 310/68 R; 361/709; 361/714; 417/410.1

(58) Field of Classification Search ..... 310/52, 310/64, 68 R, 67 R; 361/709, 714; 417/410.1
See application file for complete search history.

(56) References Cited

U.S. PATENT DOCUMENTS

| | | | | |
|---|---|---|---|---|
| 3,122,679 | A * | 2/1964 | Kislan et al. | 361/808 |
| 3,925,809 | A * | 12/1975 | Striker | 257/722 |
| 5,997,267 | A | 12/1999 | Lee | |
| 6,031,306 | A * | 2/2000 | Permuy | 310/67 R |
| 6,483,213 | B1 * | 11/2002 | Hsu | 310/68 R |
| 6,750,578 | B2 * | 6/2004 | Buening et al. | 310/89 |
| 7,015,607 | B1 * | 3/2006 | Ikuta et al. | 310/64 |
| 2004/0191095 | A1 | 9/2004 | Horng et al. | |

* cited by examiner

*Primary Examiner*—Quyen P Leung
*Assistant Examiner*—John K Kim
(74) *Attorney, Agent, or Firm*—Muncy, Geissler, Olds & Lowe, PLLC

(57) ABSTRACT

A motor includes a base having a fixing seat, an axial tube mounted to the fixing seat, a rotor mounted to the axial tube, and a circuit board mounted to the base and including a stator and at least one heat-generating component. The base includes at least one slot. At least one fixed plate is located adjacent to the slot. The fixed plate is at a different height from the base. The fixed plate is smaller than the slot. The heat-generating component is fixed to the fixed plate. The fixed plate assists in dissipation of heat generated by the heat-generating component.

8 Claims, 6 Drawing Sheets

HEAT-DISSIPATING DEVICE FOR MOTOR BASE

BACKGROUND OF THE INVENTION

1. Field of the Invention

The present invention relates to a heat-dissipating device for a motor base. More particularly, the present invention relates to a heat-dissipating device for assisting in rapid heat dissipating for heat-generating components such as IC control units, power transistors, etc of a high-power motor, thereby maintaining optimal operational efficiency of the high-power motor.

2. Description of Related Art

FIG. 1 shows a motor with a conventional heat-dissipating device for a base of the motor. The motor comprises a casing 10 having a base 11, an axial tube 12 mounted to a center of the base 11, and a rotor 13 mounted to the axial tube 12. A wall 14 extends upwardly along an outer circumference of the base 11 and connected by a plurality of ribs 15 to an inner circumference of the casing 10. A circuit board 16 is mounted on top of the base 11. A stator 18 is mounted on the circuit board 16 and aligned with a magnet (not labeled) on the rotor 13.

Heat-generating components 17 such as IC control units, power transistors, etc are mounted on the circuit board 16. Conventionally, the heat-generating components 17 are mounted to a bottom side of the circuit board 16 and located in an area surrounded by the wall 14. Since the motor is of an ordinary power such that the temperature caused by the heat-generating components 17 will not be too high to adversely affect the overall operational efficiency of the motor.

However, in a case that a high-power motor is used, the heat generated by the heat-generating components is several times of that generated by a motor with an ordinary power. Overheated and/or burn-out power transistors may occur in the motor and the operational efficiency of the motor is adversely affected, as no auxiliary heat-dissipation device is provided.

SUMMARY OF THE INVENTION

A motor in accordance with the present invention comprises a base having a fixing seat, an axial tube mounted to the fixing seat, a rotor mounted to the axial tube, and a circuit board mounted to the base and comprising a stator and at least one heat-generating component. The base includes at least one slot. At least one fixed plate is located adjacent to the at least one slot. The at least one fixed plate is at a different height from the base. The at least one fixed plate is smaller than the at least one slot. The at least one heat-generating component is fixed to the at least one fixed plate. The at least one fixed plate assists in dissipation of heat generated by the at least one heat-generating component.

The heat generated by the heat-generating component is transferred to the casing, and the rotor assists in rapid heat-dissipation for the casing, preventing heat accumulation of the heat-generating component and maintaining normal operation of the motor.

Preferably, the at least one fixed plate and the at least one slot define a space therebetween, allowing the at least one heat-generating component to extend through the space.

Preferably, a wall extends from an outer circumference of the base toward the circuit board, and the at least one fixed plate projects from an inner circumference of the wall.

In an alternative example, the at least one fixed plate projects from an outer circumference of the fixing seat.

Preferably, the circuit board comprises a positioning seat on which the at least one heat-generating component is mounted, allowing input of electronic signals to the at least one heat-generating component via pin connection.

The at least one heat-generating component may be an IC control unit or a power transistor.

In a further example, the at least one slot extends through the wall, forming an air inlet in the wall. Thus, a portion of the air currents created by the rotor may enter the base via the air inlet, allowing rapid heat-dissipation of the heat-generating component.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
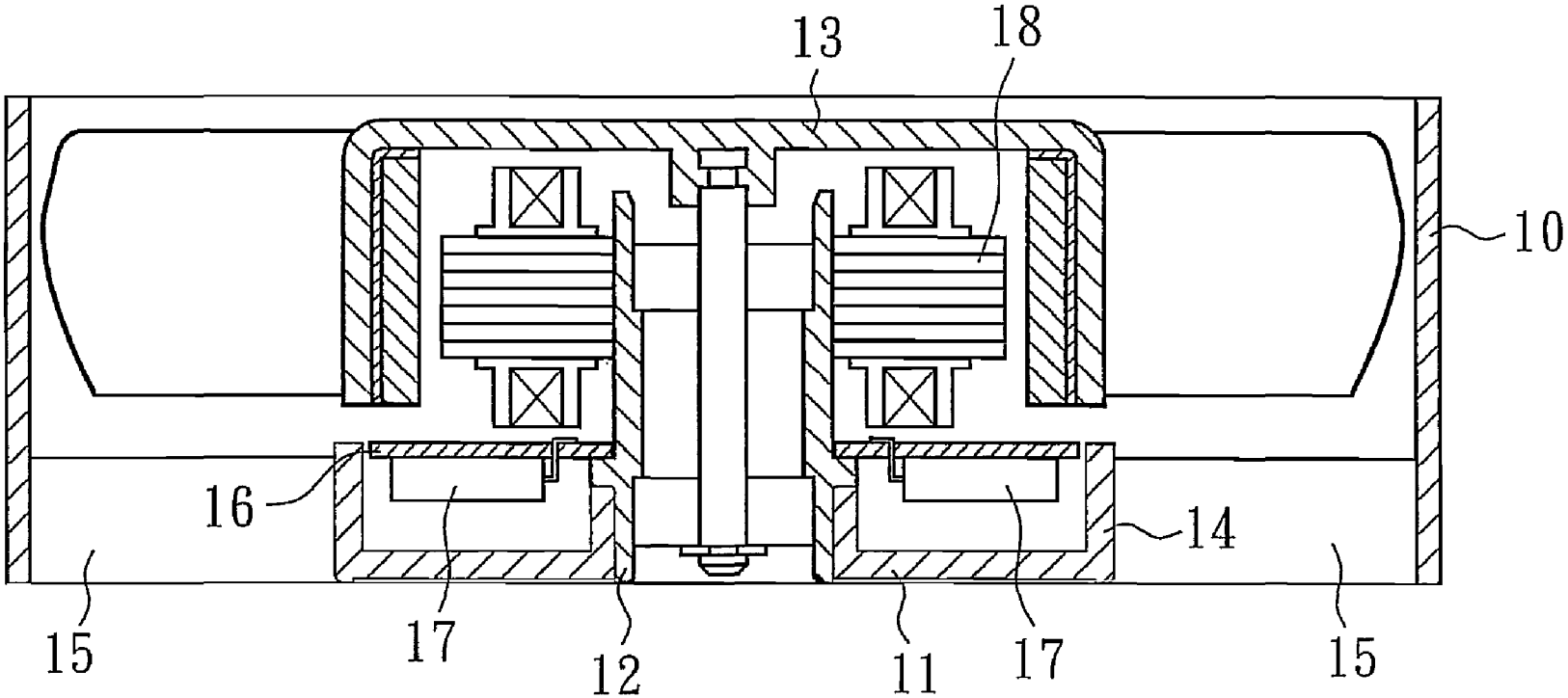
FIG. 1 PRIOR ART
FIG. 1 is a sectional view of a conventional motor with a heat-dissipating device.
Figure 2:
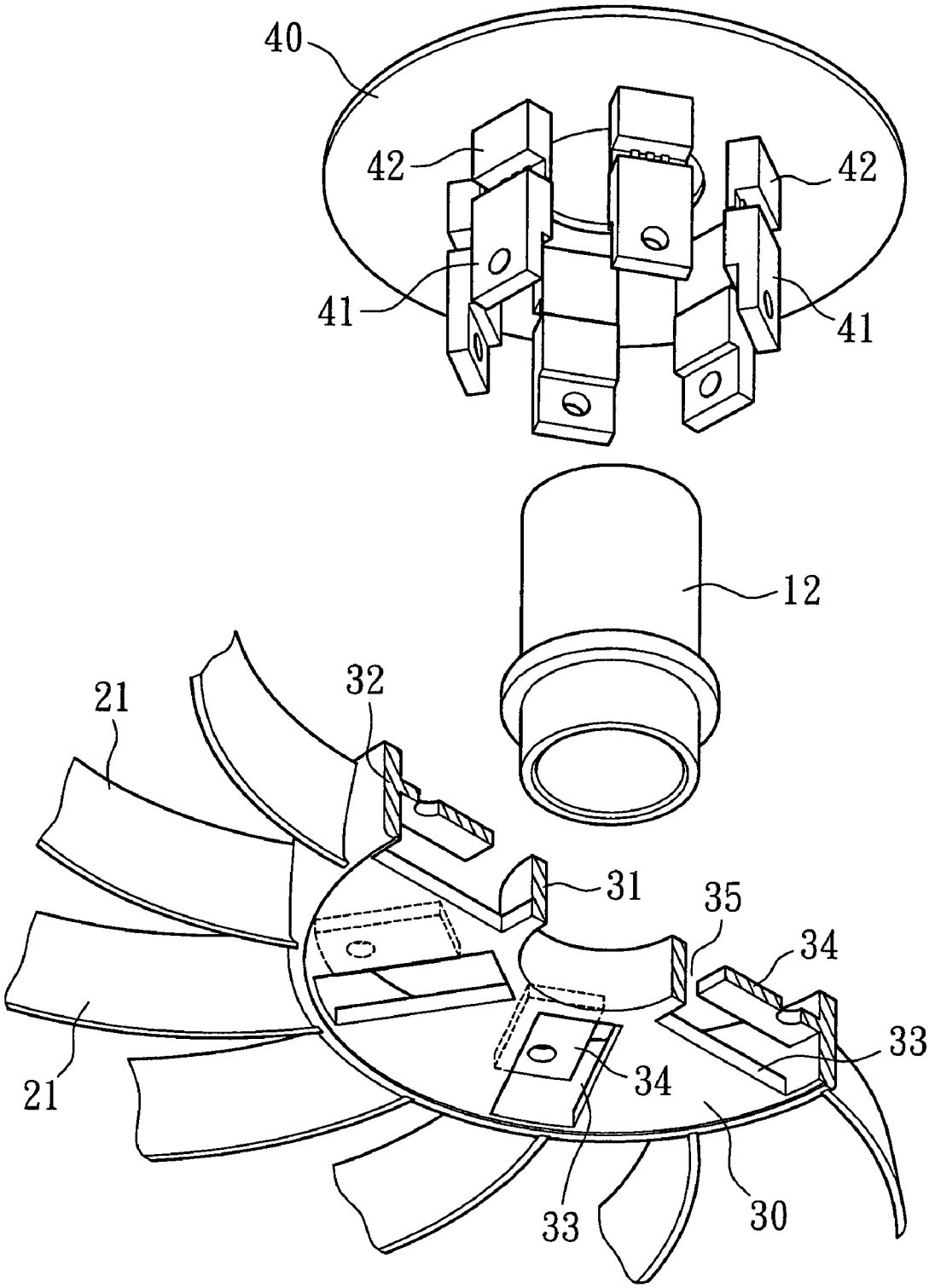
FIG. 2 is an exploded perspective view illustrating a portion of a first embodiment of a motor in accordance with the present invention.
Figure 3:
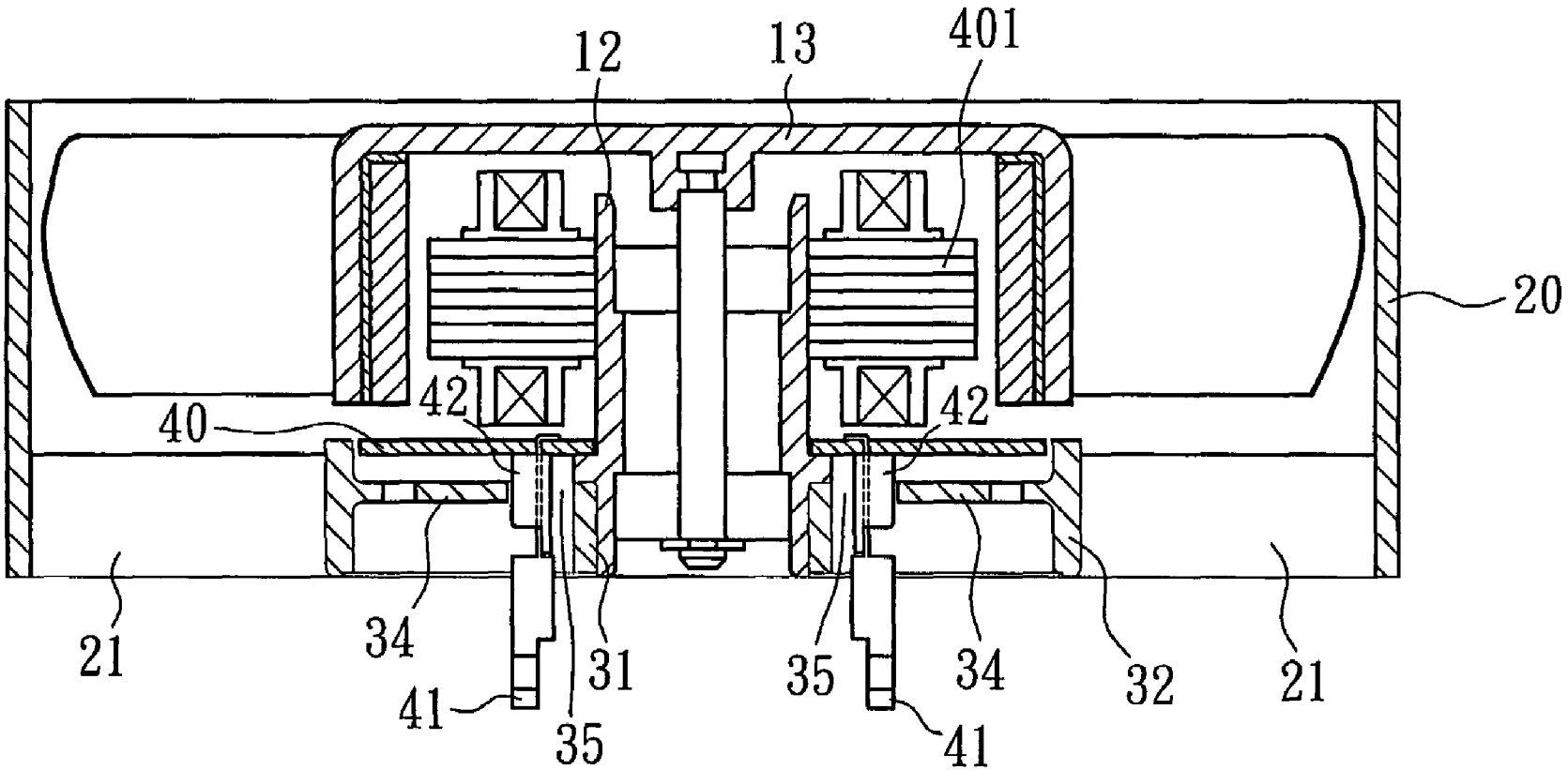
FIG. 3 is a sectional view of a semi-product of the first embodiment of the motor in accordance with the present invention.

Referring to FIGS. 2 and 3, a first embodiment of a motor in accordance with the present invention comprises a casing 20 and a rotor 13. The motor may be a high-power motor. The casing 20 includes a base 30. An axial tube 12 mounted to a fixing seat 31 located in a center of the base 30, and the rotor 13 is mounted to the axial tube 12. A wall 32 extends along an outer circumference of the base 30 and connected by a plurality of ribs 21 to an inner circumference of the casing 20. A circuit board 40 is mounted to the base 30. A stator 401 is mounted on the circuit board 40 and aligned with a magnet (not labeled) on the rotor 13.

At least one heat-generating component 41 is mounted on the circuit board 40. The heat-generating component 41 may be an IC control unit, a power transistor, etc. At least one positioning seat 42 is provided on a predetermined location of the circuit board 40, and the heat-generating component 41 is mounted on the positioning seat 42 and pin connection is carried out to allow input of electronic signals to the heat-generating component 41 for activating the high-power motor.

The base 30 includes at least one slot 33 adjacent to the heat-generating component 41 on the circuit board 40. At least one fixed plate 34 projects from an inner circumference of the wall 32 and is located at a different height from the base 30. The fixed plate 34 is spaced from the fixing seat 31. When amounts of said at least one fixed plate 34 and slot 33 are plural, the fixed plates 34 are respectively aligned with the slots 33. A length of the fixed plate 34 is smaller than that of the slot 33, providing a space 35 through which the heat-generating component 41 and the positioning seat 42 extend.

Figure 4:
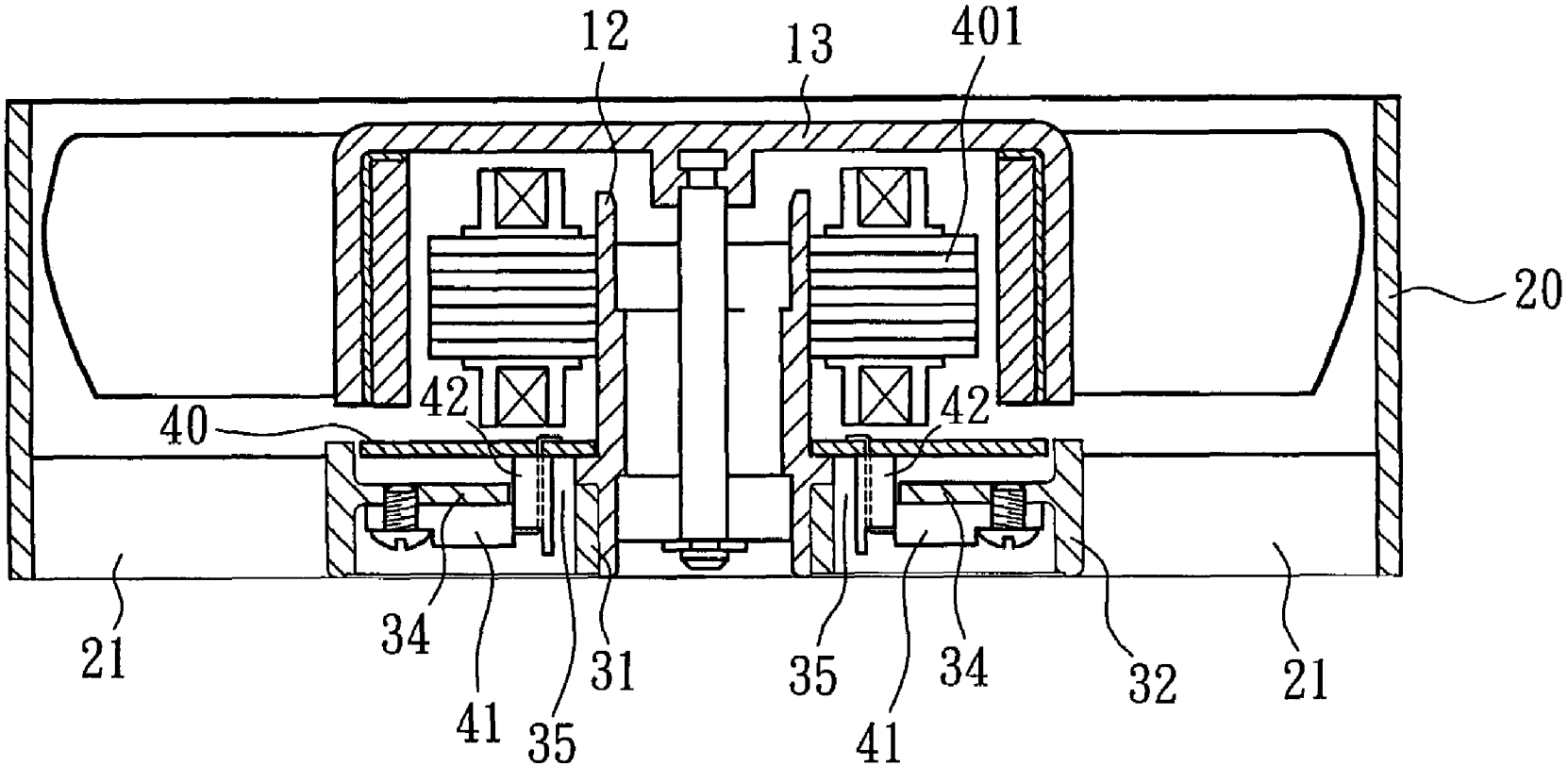
FIG. 4 is a sectional view of a final product of the first embodiment of the motor in accordance with the present invention.

As illustrated in FIG. 3, the heat-generating component 41 and the positioning seat 42 extend through the space 35. Then, the heat-generating component 41 is bent to be in flat contact with the fixed plate 34, with a part of the circuit board 40 extending in the space between the fixed plate 34 and the fixing seat 31. Said heat-generating component 41 being bent and exposed to the slot 33, as shown in FIG. 4. The heat-generating component 41 and the fixed plate 34 may be screwed together.

By such an arrangement, the heat generated by the heat-generating component 41 can be transferred through the fixed plate 34 to the base 30, the ribs 21, and the casing 20, increasing the contact area with the air for heat-dissipating purposes. In a case that a high-power motor is used, the rotor 13 can be driven to turn to provide rapid heat-dissipation, preventing heat accumulation of the heat-generating component 41 and maintaining normal operation of the high-power motor.

Figure 5:
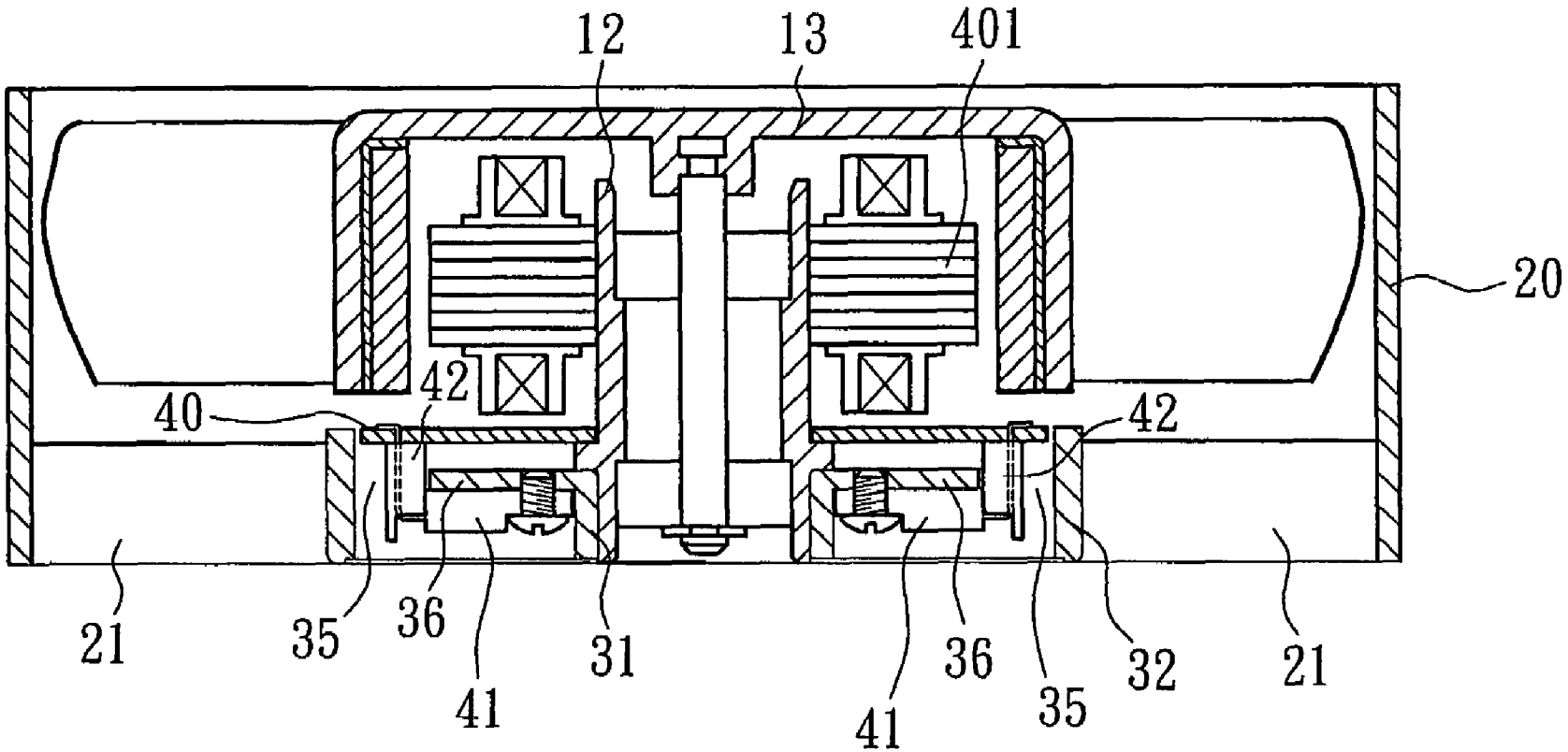
FIG. 5 is a sectional view of a second embodiment of the motor in accordance with the present invention.

FIG. 5 illustrates a second embodiment of the invention, wherein at least one fixed plate 36 projects from an outer circumference of the fixing seat 31. The fixed plate 36 is at a different height from the base 30 and is smaller than the slot 33, providing a space 35 through which the heat-generating component 41 and the positioning seat 42 extend.

Similar to the first embodiment, the heat generated by the heat-generating component 41 is transferred to the casing 20, and the rotor 13 assists in rapid heat-dissipation for the casing 20, preventing heat accumulation of the heat-generating component 41 and maintaining normal operation of the high-power motor.

Figure 6:
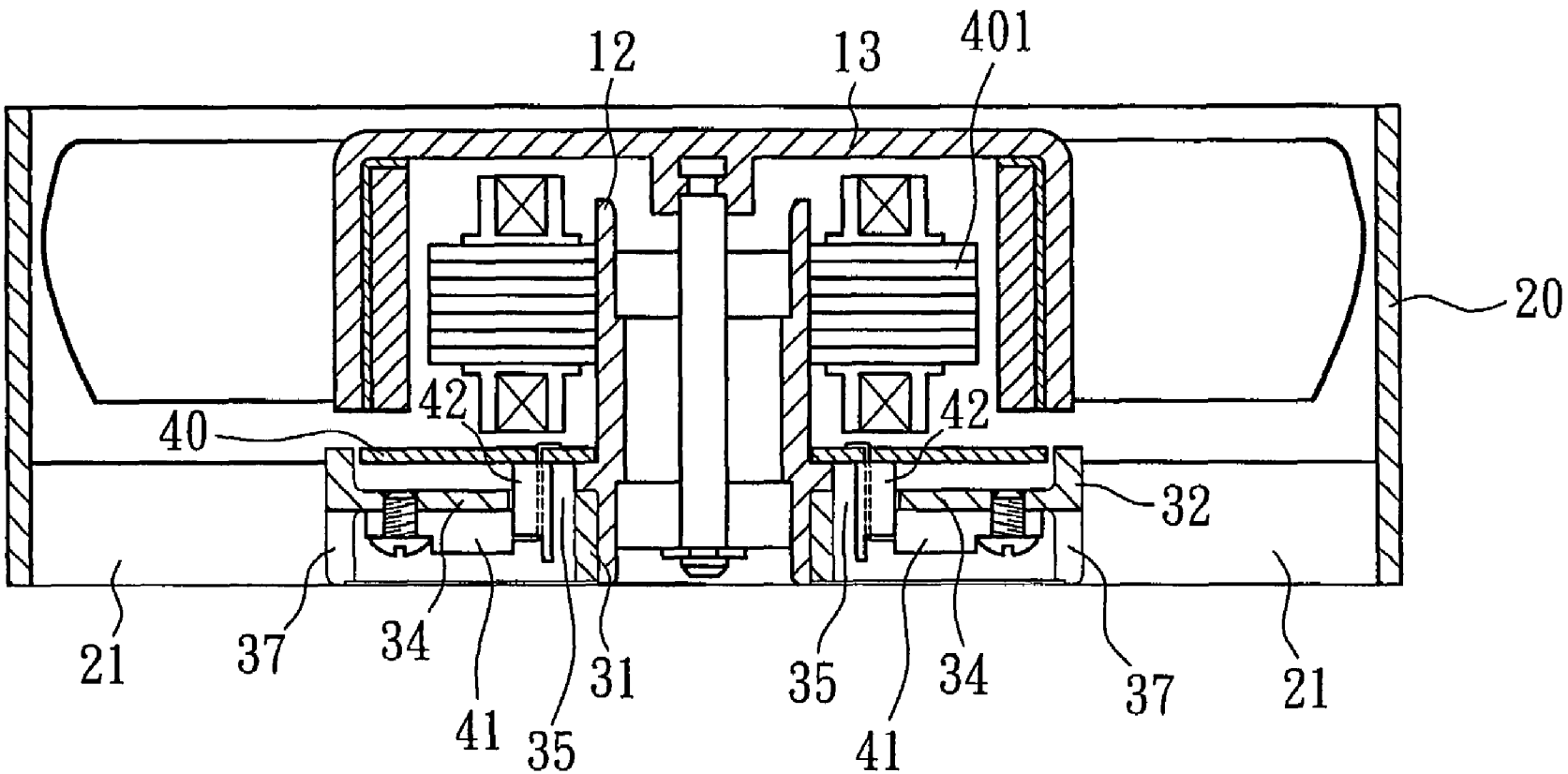
FIG. 6 is a sectional view of a third embodiment of the motor in accordance with the present invention.

FIG. 6 illustrates a third embodiment of the invention. A sticker or label bearing a trademark, model number, specification, etc of the motor is generally attached to a bottom side of the base 30 and thus seals the slot 33. In this embodiment, the slot 33 in the base 30 extends through the wall 32 to a position adjoining the fixed plate 34, forming an air inlet 37 in the wall 32. The air inlet 37 is not sealed by the label. Thus, a portion of the air currents created by the rotor 13 may enter the base 30 via the air inlet 37, allowing rapid heat-dissipation of the heat-generating component 41.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A motor comprising:

a base having a fixing seat and a wall extending axially;

an axial tube mounted to the fixing seat;

a rotor mounted to the axial tube;

a circuit board mounted to the base and comprising at least one heat-generating component;

the base including at least one slot; and at least one fixed plate radially projecting from one of the fixing seat and the wall, and being spaced from the other one of the fixing seat and the wall, with said at least one fixed plate being at a different height from the base, a length of said at least one fixed plate being smaller than a length of said at least one slot, said at least one heat-generating component being fixed to said at least one fixed plate, a part of the circuit board extending in the space between said at least one fixed plate and the fixing seat or the wall, said at least one heat-generating component being bent and exposed to the slot, and said at least one fixed plate assisting in dissipation of heat generated by said at least one heat-generating component.

2. The motor as claimed in claim 1, wherein said at least one fixed plate and said at least one slot define a space therebetween, allowing said at least one heat-generating component to extend through the space.

3. The motor as claimed in claim 1, wherein the wall extends from an outer circumference of the base toward the circuit board, with said at least one fixed plate projecting from an inner circumference of the wall.

4. The motor as claimed in claim 1, wherein said at least one fixed plate projects from an outer circumference of the fixing seat.

5. The motor as claimed in claim 1, wherein the circuit board comprises a positioning seat on which said at least one heat-generating component is mounted, allowing input of electronic signals to said at least one heat-generating component via pin connection.

6. The motor as claimed in claim 1, wherein said at least one heat-generating component is an IC control unit or a power transistor.

7. The motor as claimed in claim 3, wherein said at least one slot extends through the wall, forming an air inlet in the wall.

8. The motor as claimed in claim 1, wherein said at least one fixed plate is a plurality of fixed plates and said at least one slot is a plurality of slots, and the fixed plates are respectively aligned with the slots.

* * * * *